US010329849B2

(12) United States Patent
Tian et al.

(10) Patent No.: US 10,329,849 B2
(45) Date of Patent: Jun. 25, 2019

(54) MULTI-FUNCTIONAL DRILLING EXPERIMENT PLATFORM

(71) Applicant: Southwest Petroleum University, Chengdu (CN)

(72) Inventors: Jialin Tian, Chengdu (CN); Zhi Zhu, Chengdu (CN); Ping Chen, Chengdu (CN); Dejie Chen, Chengdu (CN); Yanniu Ren, Chengdu (CN); Qiang Wang, Chengdu (CN)

(73) Assignee: SOUTHWEST PETROLEUM UNIVERSITY, Chengdu (CN)

( * ) Notice: Subject to any disclaimer, the term of this patent is extended or adjusted under 35 U.S.C. 154(b) by 3 days.

(21) Appl. No.: 15/579,601

(22) PCT Filed: Jun. 8, 2017

(86) PCT No.: PCT/CN2017/087563
§ 371 (c)(1),
(2) Date: Dec. 5, 2017

(87) PCT Pub. No.: WO2018/120653
PCT Pub. Date: Jul. 5, 2018

(65) Prior Publication Data

US 2019/0078395 A1 Mar. 14, 2019

(30) Foreign Application Priority Data

Dec. 26, 2016 (CN) ..... 2016 1 1214161

(51) Int. Cl.
*E21B 15/04* (2006.01)
*E21B 17/02* (2006.01)
(Continued)

(52) U.S. Cl.
CPC ..... *E21B 15/045* (2013.01); *E21B 7/026* (2013.01); *E21B 15/00* (2013.01); *E21B 17/021* (2013.01); *E21B 7/024* (2013.01)

(58) Field of Classification Search
CPC ..... E21B 7/024; E21B 7/026; E21B 15/045; E21B 17/021
See application file for complete search history.

(56) References Cited

U.S. PATENT DOCUMENTS 4,606,155 A * 8/1986 Bukovitz ..... E04H 12/34 173/193
5,213,169 A * 5/1993 Heller ..... E21B 4/20 173/185

(Continued)

FOREIGN PATENT DOCUMENTS

CN 101806214 A 8/2010
CN 201955275 U 8/2011

(Continued)

*Primary Examiner* — Taras P Bemko
(74) *Attorney, Agent, or Firm* — Gokalp Bayramoglu

(57) ABSTRACT

The present invention relates to a multi-functional drilling experiment platform, which consists of a gantry, a hydraulic cylinder, a power swivel and a platform base. The gantry mainly realizes the control of the drill string during the drilling-in process. In order to simulate the vertical well, the inclined well, and the horizontal well, the drilling machine needs to rotate between 0° and 90°. The rotation of the gantry is realized by the extension and contraction of the hydraulic cylinder. The platform base is used to set up the gantry and the hydraulic cylinder, bearing the pulling, pressing and twisting loads of drilling experiments. Also, the platform base can move along the track to achieve different types of experiments. The multi-functional drilling experiment platform of the present invention realizes the load simulation experiment of the drilling machine at different angles using the gantry and the hydraulic cylinder.

7 Claims, 6 Drawing Sheets

(51) Int. Cl.
*E21B 7/02* (2006.01)
*E21B 15/00* (2006.01)

(56) References Cited

U.S. PATENT DOCUMENTS 5,524,716 A 6/1996 Wachholz
9,797,196 B2 * 10/2017 Taggart ..... E21B 7/023

FOREIGN PATENT DOCUMENTS

CN 103196686 A 7/2013
CN 203769758 U 8/2014
CN 204436367 U 7/2015
CN 106593310 A 4/2017
JP 11190185 A 7/1999

* cited by examiner

MULTI-FUNCTIONAL DRILLING EXPERIMENT PLATFORM

CROSS REFERENCE TO RELATED APPLICATIONS

This application is the national phase entry of International Application No. PCT/CN2017/087563, filed on Jun. 8, 2017, which is based upon and claims priority to Chinese Application No. 201611214161.6, filed on Dec. 26, 2016, the entire contents of which are incorporated herein by reference.

TECHNICAL FIELD

The present invention relates to a multi-functional drilling experiment platform used in the field of fossil oil drilling simulation experiment.

BACKGROUND

With the growing demand for fossil oil energy at home and abroad, domestic oilfield companies not only attach importance to the exploration and exploitation of domestic fossil oil resources, but also actively participate in the competition in foreign markets. The advanced and reliable drilling tools are the reliable guarantee for fossil oil exploration and development. With the rapid development of drilling technology, many new drilling processes, new technologies, and new tools emerged, requiring the adaptiveness of the experimental techniques and methods of drilling. In many ways, small-scale lab equipment cannot meet the requirements for today's development of the drilling technology. To overcome and avoid the risks of the field experiments caused by the hidden portions, and complexity of the drilling process, to explore the improvement of the quality and speed of drilling, to control the drilling cost, and to prevent and solve drilling complications and accidents, many domestic and foreign oil companies and research institutes have successively established drilling, oil production, well control and other experimental wells, so that drilling and other technological achievements are more scientific and reliable. At present, the technical bottleneck which holds back domestic drilling scientists and technicians from innovating and developing new drilling technologies, new technologies, and new tools is a lack of an intermediate multi-functional drilling experiment platform which can systematically and completely test the performance and technical parameters of these new drilling technologies, and new tools. The multi-functional drilling experiment platform is an indispensable experimental manner to carry out a lot of technical research of down-hole tools and processes. Therefore, it is urgent to develop a scientific and industrial multi-functional drilling experiment platform.

The on-site experimental well can only provide a single operating condition. However, a variety of underground complications and accidents are unlikely to occur. Further, the down-hole complications and accidents are the consequences that drilling workers hate to see. Moreover, it is not proper to arbitrarily change the production operating conditions for the experimental purpose, since such change will increase the risk of production operations. With the research results of the computer hardware science and technology and related engineering simulation software, the simulating experimental wells have become an efficient, reliable and convenient new tool, a new process design and a testing tool. However, considering the long-term technical and economic benefits, it is not appropriate to use the on-site production experimental well experiments instead of the simulated experimental well experiments. In summary, only the simulation experiments can obtain the intermediate experimental data that cannot be obtained in the on-site experiments or in a short period of time. Moreover, only the simulation experiments can greatly shorten the experimental period, effectively overcoming the deficiency of blindly putting new products and new technologies into the field production well without any intermediate experiments. Thus, some unnecessary work and economic losses can be avoided. Thus, the achievements of scientific research are more scientific, reliable, practical and economical.

SUMMARY OF THE INVENTION

The objective of the present invention is to provide a multi-functional drilling experiment platform to simulate horizontal wells, inclined wells, and vertical wells by changing the angle of the gantry hydraulically, which can provide powers of hoisting, pressurizing and rotating for various drilling tools and process experiments. Further, the multi-functional drilling experiment platform can also realize the drilling fluid circulation, and fitting the well holes with different angles. The multi-functional drilling experiment platform has a good reliability, working performance, safety, and stability. The multi-functional drilling experiment platform of the present invention uses a gantry and a hydraulic cylinder to realize the loading simulation experiments of the drilling machine at different angles. Intermediate experimental data that cannot be obtained by on-site experiments or in a short period, can be obtained. Thus, the use of the new products and the new processes in on-site production wells can be effectively implemented.

The technical solution of the present invention is that a multi-functional drilling experiment platform is composed of a gantry, a hydraulic cylinder, a power swivel and a platform base. The gantry comprises a gantry rib, a gantry column, a column support lug, a crossbeam, a pulling-pressing hydraulic cylinder lug, a pulling-pressing force sensor, a gantry double lug, a limiting platform, a guide pillar mounting seat, a guide pillar, a guide pillar rib, a crossbeam guide seat, and a crossbeam support lug. The gantry rib is fixed on two gantry columns by bolts. The column support lug is fixed on the gantry column by welding. The guide pillar mounting seat, the guide pillar, and the guide pillar rib are installed in the U-shaped steel channel of the guide pillar. The crossbeam guide seat is fixed with both ends of the crossbeam by screws. The crossbeam guide seat (31) is configured to move upwards and downwards through the cooperation of the crossbeam guide seat and the guide pillar. The hydraulic cylinder of the multi-functional drilling experiment platform is divided into a pitching hydraulic cylinder and a pulling-pressing hydraulic cylinder. The pitching hydraulic cylinder is composed of a pitching hydraulic cylinder plunger and a pitching hydraulic cylinder block. The pulling-pressing hydraulic cylinder is composed of a pulling-pressing hydraulic cylinder block and a pulling-pressing hydraulic cylinder plunger. The pitching hydraulic cylinder plunger is connected to the column support lug by a pin a. The length of the pitching hydraulic cylinder is changed by a hydraulic control system to realize the rotation of the gantry. The pulling-pressing hydraulic cylinder block is fixed on both ends of the crossbeam through a trunnion seat. The pulling-pressing hydraulic cylinder plunger is installed on the pulling-pressing hydraulic cylinder lug by a pin b. The length of the pulling-pressing hydraulic cylinder is changed by the hydraulic control system to move the crossbeam along the guide pillar. A power swivel is in the middle of the crossbeam. The power swivel is composed of a hydraulic motor and a reduction gear. The platform base includes a gantry support lug, a platform pedestal, a drill rod clamping device and a track slider. The gantry support lug is installed on the platform pedestal by bolts. The drill rod clamping device is installed under a wellbore of the platform pedestal, so as to clamp the experimental drill rod. The track sliders are provided on both sides of the platform pedestal which is convenient for cooperating with a ground track to realize the movement of the multi-functional drilling experiment platform. A gantry double lug is connected to the gantry support lug through a pin shaft. An angle of the gantry with respect to a ground is changed under an action of the pitching hydraulic cylinder to achieve multi-angle drilling experimental simulation. Since the experimental simulations are mostly vertical drilling experiment simulations, a rotary pin shaft is used to strengthen the gantry double lug and the gantry support lug to increase a reliability of the experiment platform.

In the multi-functional drilling experiment platform mentioned above, in order to realize the rotation of a drilling tool, a continuously-rotating low-speed and high-torque hydraulic motor is used. The power swivel is designed at a center position of the crossbeam of the experimental drilling. A gear needs to be used between the hydraulic motor and the drilling tool to achieve drilling rate and force transmission.

In the multi-functional drilling experiment platform mentioned above, in order to simulate the function of the drilling pressure of drilling in and a pulling force for lifting, two telescopic pulling-pressure hydraulic cylinders are fixed on the drilling machine to control a displacement of the power swivel. A pulling-pressing force sensor is placed at a lower end of the pulling-pressing hydraulic cylinder plunger to give feedback of applied pulling force and pressing force when the experiment platform is simulating drilling.

In the multi-functional drilling experiment platform mentioned above, in order to realize a multi-functional simulation of vertical wells, inclined wells, and horizontal wells, the drilling machine is required to rotate between 0° and 90°. The pitching hydraulic cylinder is stretched out and drawn back to drive the gantry to rotate around the pin shaft to achieve drilling at different angles.

In the multi-functional drilling experiment platform mentioned above, the drill rod clamping device is installed at the wellhead position on a bottom of the platform pedestal by a screw connection. The drill rod clamping device is composed of a clamping cylinder block, a clamping hydraulic cylinder plunger, a clamping holder, a clamping block, a spacer block, and a gland. The hydraulic control system is used to change hydraulic pressure, and the clamping hydraulic cylinder plunger works on the clamping block to clamp the drill rod.

The multi-functional drilling experiment platform mentioned above simulates a drilling experiment between 0° and 90°. A groove and a shearing force bar are designed to increase the capacity of the screw of the gantry support lug to withstand shearing force.

In the multi-functional drilling experiment platform mentioned above, in order to increase the stability during work, a rotary pin shaft is installed at the gantry support lug of the gantry which cooperates with the pitching cylinder for support.

The beneficial effects of the present invention are as follows. (1) The telescopic hydraulic cylinder is used to change the angle of the gantry with respect to the ground to realize the multi-angle drilling simulation experiment. The problem of the simplicity of the general experimental experiment platform is solved. The multi-functional drilling experimental platform can highly simulate a variety of working conditions in the field. (2) A variety of down-hole tools and process experiments have their own special requirements. The multi-functional experiment platform can simulate and meet all technical requirements. The great risks of the on-site experiment caused by the hidden portions and complexity of the drilling process can be well addressed. At the same time, the multi-functional experiment platform can simulate the experiments of new processes, new technologies, and new equipment, reducing the risk of field experiment significantly. (3) The multi-functional drilling experimental platform is used to perform the simulation, so that the intermediate experimental data which cannot be obtained by the on-site experiment or in a short period, can be quickly obtained. (4) The experimental period can be greatly shortened, effectively overcoming the deficiency of blindly putting new products and new processes into on-site production wells without any intermediate experiments. (5) Some unnecessary work and economic losses can be avoided. The research achievements are more scientific, reliable, practical and economical.

Figure 1:
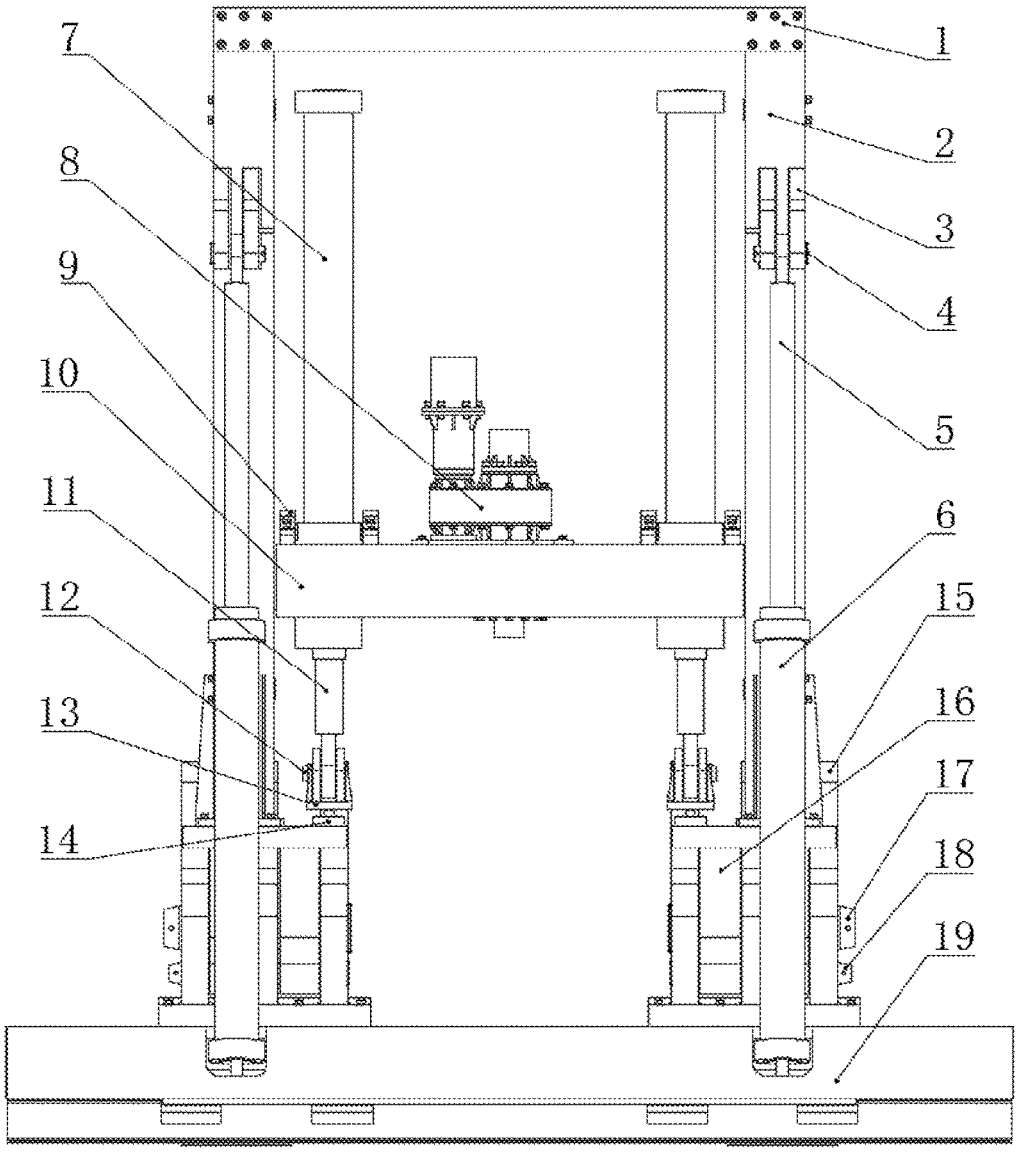
FIG. 1 is a schematic structural diagram of the present invention.
Figure 2:
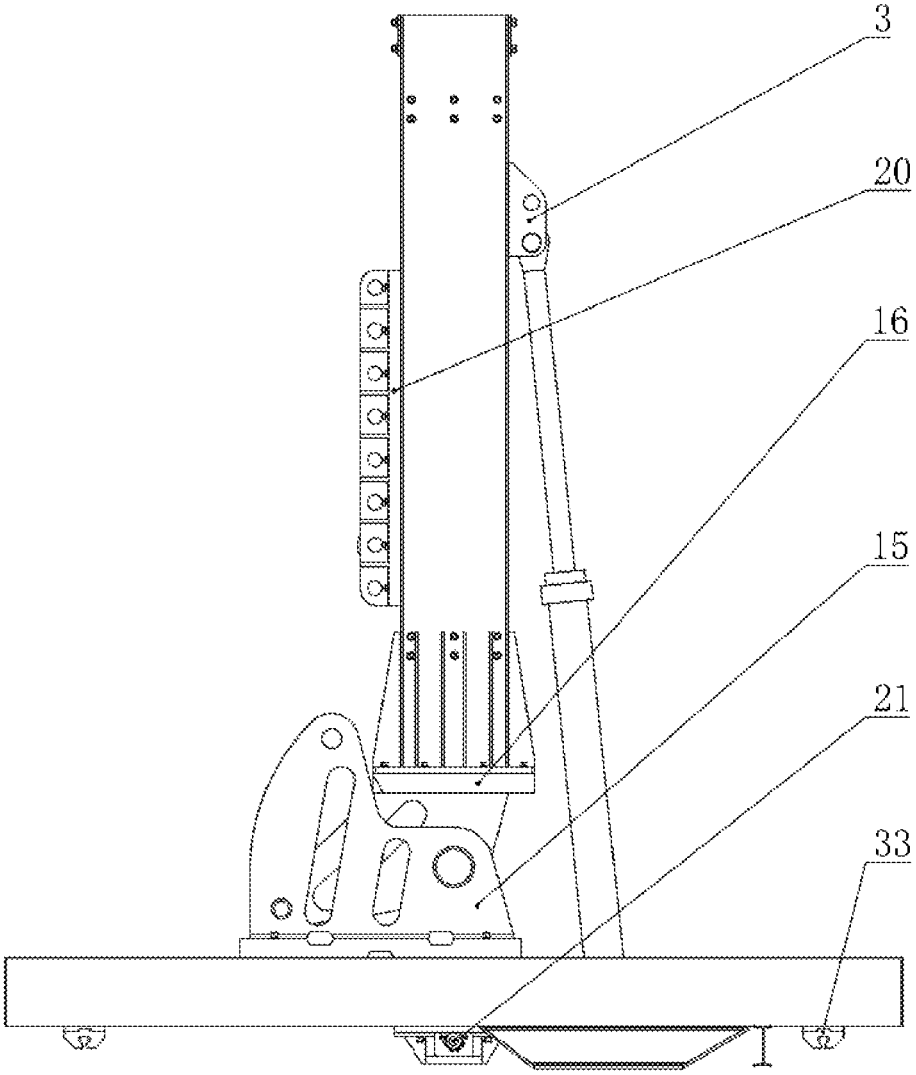
FIG. 2 is a side view of FIG. 1 of the present invention.
Figure 3:
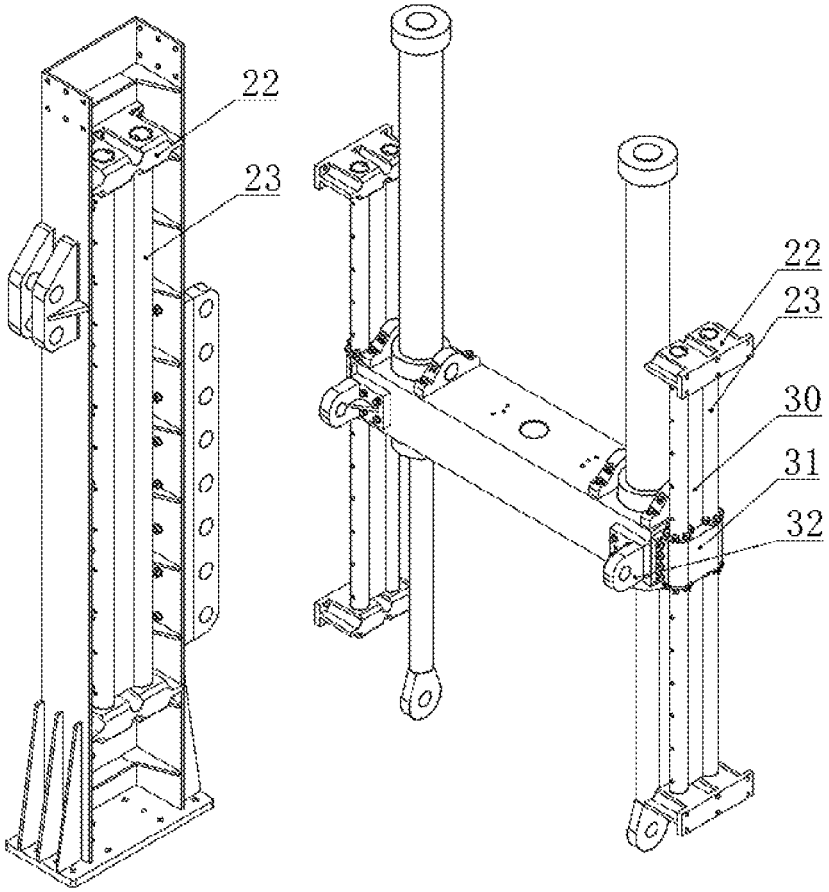
FIG. 3 is a schematic structural diagram of a column and a crossbeam of the gantry.
Figure 4:
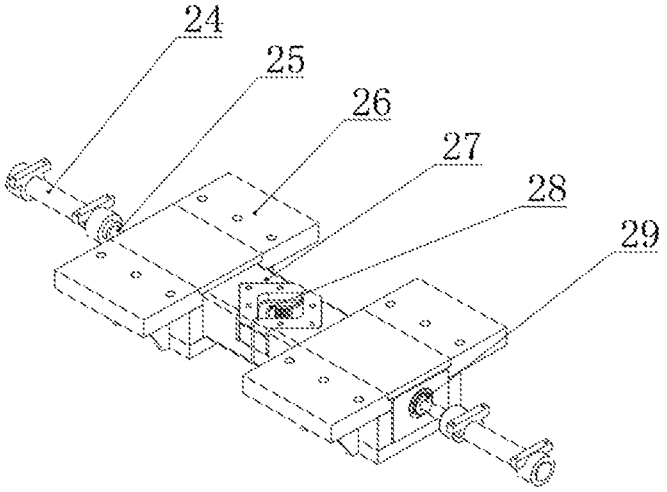
FIG. 4 is a schematic structural diagram of a drill rod clamping device.
Figure 5:
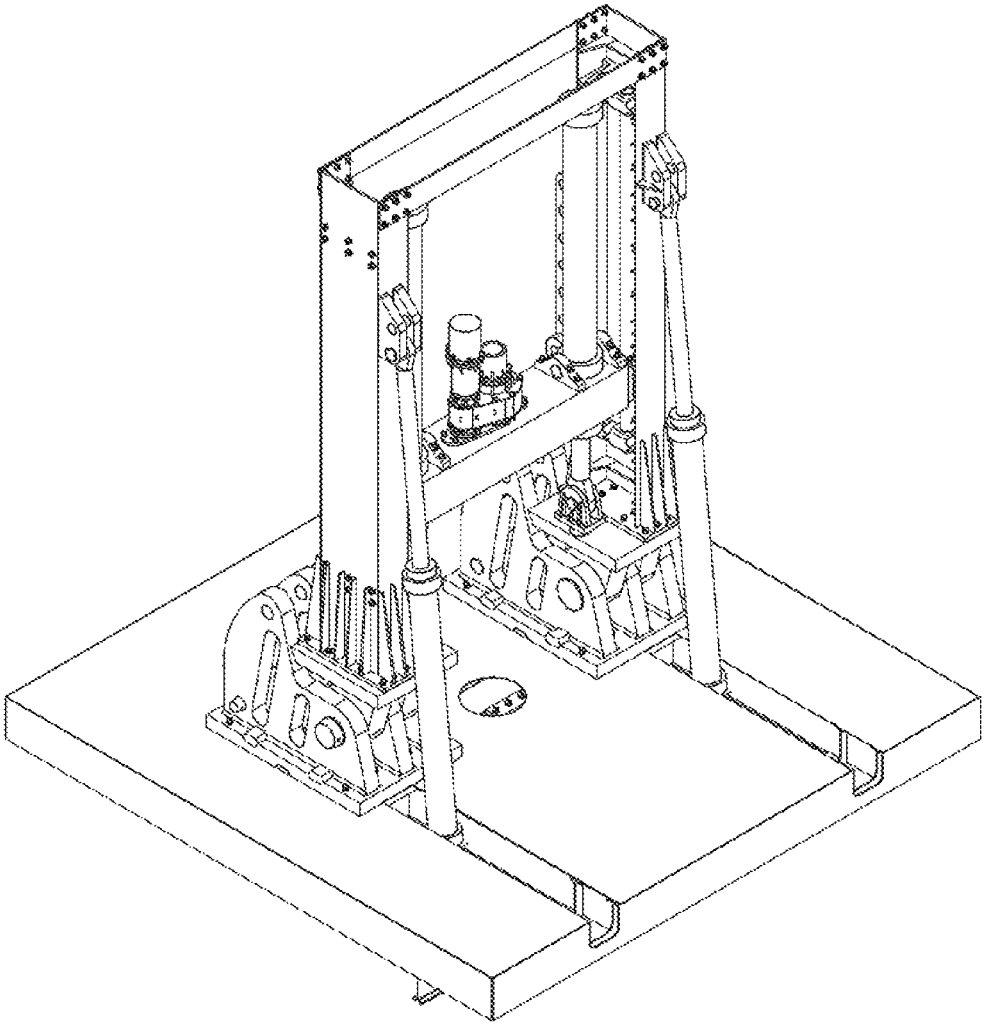
FIG. 5 is a three-dimensional structural diagram of the present invention.
Figure 6:
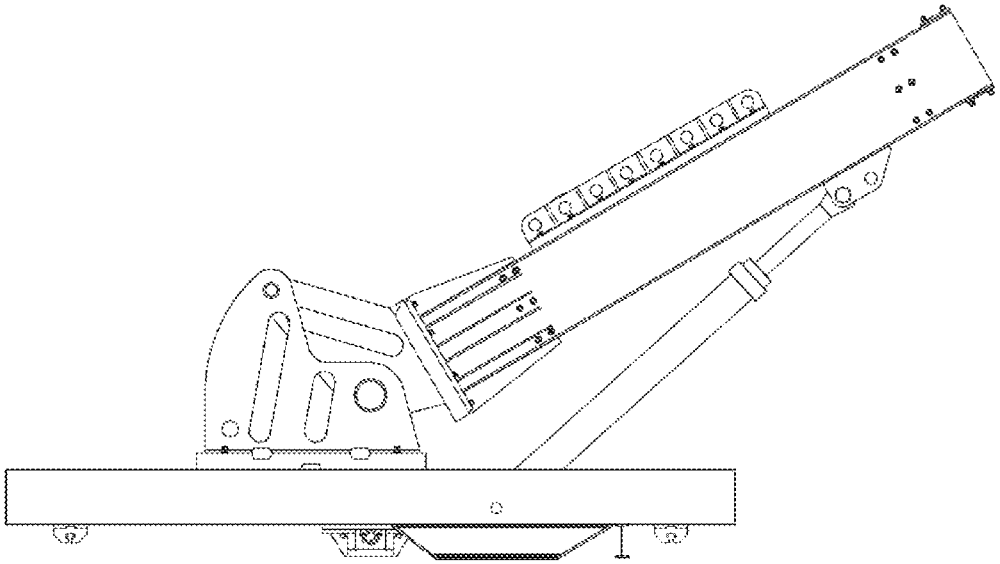
FIG. 6 is a schematic diagram of the simulation of the drilling at 60° of the multi-functional drilling experiment platform.
Figure 7:
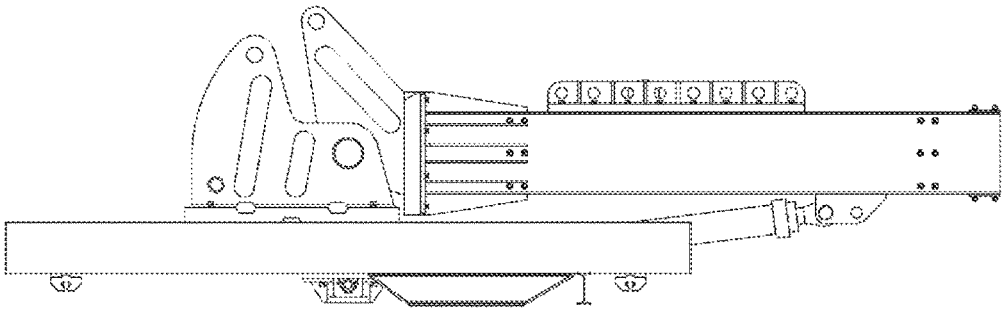
FIG. 7 is a schematic diagram of the simulation of the horizontal drilling of the multi-functional drilling experiment platform.
Figure 8:
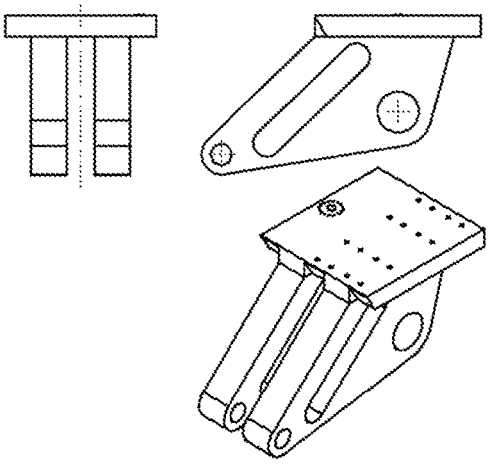
FIG. 8 is a schematic structural diagram of a gantry double lug.
Figure 9:
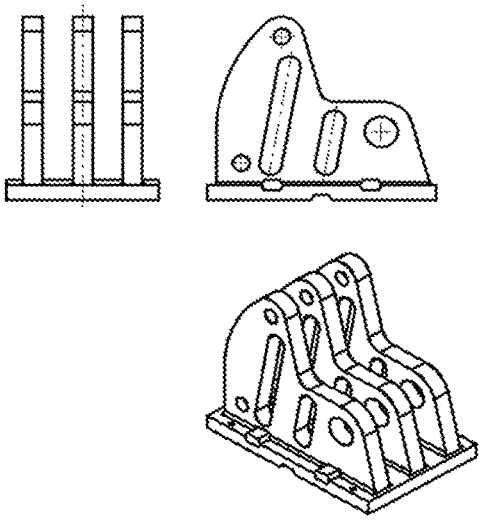
FIG. 9 is a schematic structural diagram of a gantry support lug.

In the Figures: 1. gantry ribs, 2. gantry column, 3. column support lug, 4. pin a, 5. pitching hydraulic cylinder plunger, 6. pitching hydraulic cylinder block, 7. pulling-pressing hydraulic cylinder block, 8. power swivel, 9. trunnion base, 10. crossbeam, 11. pulling-pressing hydraulic cylinder plunger, 12. pin b, 13. pulling-pressing hydraulic cylinder support lug, 14. pulling-pressing force sensor 15. gantry support lug, 16. gantry double lug, 17. pin shaft, 18. rotary pin shaft, 19. platform pedestal, 20 limiting platform, 21. drill rod clamping device, 22. guide pillar mounting seat, 23. guide pillar, 24. clamping cylinder block, 25. clamping hydraulic cylinder plunger, 26. clamping holder, 27. clamping block, 28. spacer block, 29. gland, 30. guide pillar rib, 33. crossbeam guide seat, 32. crossbeam support lug, 33. track slider.

DETAILED DESCRIPTION OF THE INVENTION

Hereinafter, the present invention is further described with reference to the accompanying drawings:

Referring to the drawings, a multi-functional drilling experiment platform is characterized in that the drilling experiment platform includes a gantry, a hydraulic cylinder, a power swivel and a platform base. The gantry includes gantry rib 1, gantry column 2, column support lug 3, crossbeam 10, pulling-pressing hydraulic cylinder support lug 13, pulling-pressing force sensor 14, gantry double lug 16, limiting platform 20, guide pillar mounting seat 22, guide pillar 23, guide pillar rib 30, crossbeam guide seat 31, and crossbeam support lug 32. Gantry rib 1 fastens two gantry columns 2 by bolt. Column support lug 3 is fixed on gantry column 2 by welding. Guide pillar mounting seat 22, guide pillar 23 and guide pillar rib 30 are installed in the U-shaped steel channel of the guide pillar. Crossbeam guide seat 31 is fixed at both ends of crossbeam 10 by screws. Crossbeam guide seat 31 can move upwards and downwards through the cooperation of crossbeam guide seat 31 and guide pillar 23.

The hydraulic cylinder of the multi-functional drilling experiment platform is divided into a pitching hydraulic cylinder and a pulling-pressing hydraulic cylinder. The pitching hydraulic cylinder is composed of pitching hydraulic cylinder plunger 5 and pitching hydraulic cylinder block 6. The pulling-pressing hydraulic cylinder is composed of pulling-pressing hydraulic cylinder block 7 and pulling-pressing hydraulic cylinder plunger 11. Pitching hydraulic cylinder plunger 5 is connected to column support lug 3 by pin a 4. The length of the pitching hydraulic cylinder is changed by a hydraulic control system to realize the rotation of the gantry. Pulling-pressing hydraulic cylinder block 7 is fixed on both ends of crossbeam 10 through trunnion seat 9. Pulling-pressing hydraulic cylinder plunger 11 is installed on pulling-pressing hydraulic cylinder support lug 13 by pin b 12. The length of the pulling-pressing hydraulic cylinder is changed by the hydraulic control system to move crossbeam 10 along guide pillar 23. Power swivel 8 is in the middle of crossbeam 10. The power swivel is composed of a hydraulic motor and a reduction gear.

The platform base comprises gantry support lug 15, platform pedestal 19, drill rod clamping device 21 and track slider 33. Gantry support lug 15 is installed to platform pedestal 19 by bolts. Drill rod clamping device 21 is installed under a wellbore of platform pedestal 19, so as to clamp the experimental drill rod easily. Track slider 33 is provided on both sides of platform pedestal 19 to cooperate with a ground track to realize the movement of the multi-functional drilling experiment platform. Gantry double lug 16 is connected to gantry support lug 15 through pin shaft 17. The angle of the gantry with respect to the ground is changed under the action of the pitching hydraulic cylinder to achieve multi-angle drilling experimental simulation. Since the experimental simulations are mostly vertical drilling experimental simulations, rotary pin shaft 18 is used to strengthen gantry double lug 16 and gantry support lug 15 to increase the reliability of the experiment platform.

Drill rod clamping device 21 of the multi-functional drilling experiment platform is installed at the wellhead position on the bottom of platform pedestal 19 by a screw connection. Drill rod clamping device 21 is composed of clamping cylinder block 24, clamping hydraulic cylinder plunger 25, clamping holder 26, clamping block 27, spacer block 28, and gland 29. The hydraulic control system is used to change hydraulic pressure. Clamping hydraulic cylinder plunger 25 is worked on clamping block 27 to clamp the drill rod.

In order to realize the function of the pulling force and pressing force required by the drilling simulation, the multi-functional drilling experiment platform uses two telescopic pulling-pressing hydraulic cylinders fixed on the drilling machine. Also, pulling-pressing force sensor 14 is used to give feedback of applied pulling force and pressing force when the experiment platform is simulating the drilling. In order to realize a multi-functional simulation of vertical wells, inclined wells, and horizontal wells, the drilling machine is required to rotate between 0° and 90°, the pitching hydraulic cylinder is stretched out and drawn back to drive the gantry to rotate around pin shaft 17 to achieve the drilling at different angles.

What is claimed is:

1. A multi-functional drilling experiment platform, comprising:

a gantry, a hydraulic cylinder, a power swivel, and a platform base, wherein the gantry comprises a gantry rib, a gantry column, a column support lug, a crossbeam, a pulling-pressing hydraulic cylinder lug, a pulling-pressing force sensor, a gantry double lug, a limiting platform, a guide pillar mounting seat, a guide pillar, a guide pillar rib, a crossbeam guide seat, and a crossbeam support lug;

the gantry rib is fixed on two gantry columns by bolts, the column support lug is fixed on the gantry column by welding, the guide pillar mounting seat, the guide pillar, and the guide pillar rib are installed in a U-shaped steel channel of the gantry column;

the crossbeam guide seat is fixed with both ends of the crossbeam by screws, the crossbeam guide seat is configured to move upwards and downwards through the cooperation of the crossbeam guide seat and the guide pillar;

the hydraulic cylinder of the multi-functional drilling experiment platform is divided into a pitching hydraulic cylinder and a pulling-pressing hydraulic cylinder, the pitching hydraulic cylinder is composed of a pitching hydraulic cylinder plunger and a pitching hydraulic cylinder block the pulling-pressing hydraulic cylinder is composed of a pulling-pressing hydraulic cylinder block and a pulling-pressing hydraulic cylinder plunger;

the pitching hydraulic cylinder plunger is connected to the column support lug by a first pin, the length of the pitching hydraulic cylinder is changed by a hydraulic control system to realize a rotation of the gantry;

the pulling-pressing hydraulic cylinder block is fixed on both ends of the crossbeam through a trunnion seat, the pulling-pressing hydraulic cylinder plunger is installed on the pulling-pressing hydraulic cylinder lug by a second pin, the length of the pulling-pressing hydraulic cylinder is changed by the hydraulic control system to move the crossbeam along the guide pillar;

the power swivel is in a middle of the crossbeam, the power swivel is composed of a hydraulic motor and a reduction gear;

the platform base comprises a gantry support lug, a platform pedestal, a drill rod clamping device, and a track slider;

the gantry support lug is installed to the platform pedestal by bolts, the drill rod clamping device is installed under a wellbore of the platform pedestal to clamp the experimental drill rod;

the track slider is provided on both sides of the platform pedestal to cooperate with a ground track to realize a movement of the multi-functional drilling experiment platform;

a gantry double lug is connected to the gantry support lug through a pin shaft, an angle of the gantry with respect to a ground is changed under an action of the pitching hydraulic cylinder to achieve multi-angle drilling experimental simulation, and since the experimental simulation is mostly vertical drilling experiment simulation, a rotary pin shaft is used to strengthen the gantry double lug and the gantry support lug to increase a reliability of the experiment platform.

2. The multi-functional drilling experiment platform according to claim 1, wherein the power swivel is designed at a center position of the crossbeam of the experimental drilling machine, and the reduction gear is required to achieve a transmission of drilling speed and force between the hydraulic motor and the drilling tool.

3. The multi-functional drilling experiment platform according to claim 1, wherein in order to simulate a function of a drilling pressure of drilling in and a pulling force for lifting, two telescopic pulling-pressure hydraulic cylinders are fixed on the drilling machine to control a displacement of the power swivel; and a pulling-pressing force sensor is placed at a lower end of the pulling-pressing hydraulic cylinder plunger to give feedback of applied pulling force and pressing force when the experiment platform is simulating drilling.

4. The multi-functional drilling experiment platform according to claim 1, wherein in order to realize multi-functional simulations of vertical wells, inclined wells, and horizontal wells, the drilling machine needs to rotate between 0° and 90°, and the pitching hydraulic cylinder is stretched out and drawn back to drive the gantry to rotate around the pin shaft to achieve drilling at different angles.

5. The multi-functional drilling experiment platform according to claim 4, wherein the multi-functional drilling experiment platform simulates a drilling experiment between 0° and 90°, a groove and a shearing force bar is designed to increase capacity of the screw of the gantry support lug to withstand shearing force.

6. The multi-functional drilling experiment platform according to claim 4, wherein in order to increase a stability during work, the rotary pin shaft is installed at the gantry support lug which cooperates with the pitching cylinder to support.

7. The multi-functional drilling experiment platform according to claim 1, wherein the drill rod clamping device is installed at a wellhead position on a bottom of the platform pedestal by a screw connection, the drill rod clamping device is composed of a clamping cylinder block, a clamping hydraulic cylinder plunger, a clamping holder, a clamping block, a spacer block, a gland;

the hydraulic control system is used to change hydraulic pressure, and the clamping hydraulic cylinder plunger works on the clamping block to clamp the drill rod.

* * * * *